United States Patent [19]

Kobayashi

[11] Patent Number: 4,726,800

[45] Date of Patent: Feb. 23, 1988

[54] RADIO-CONTROLLABLE SPHERICAL TOY VEHICLE

[75] Inventor: Masao Kobayashi, Tochigi, Japan

[73] Assignee: Shinsei Kogyo Co., Ltd., Tokyo, Japan

[21] Appl. No.: 789,393

[22] Filed: Oct. 21, 1985

[30] Foreign Application Priority Data

May 22, 1985 [JP] Japan ..... 60-109759

[51] Int. Cl.[4] ..... A63H 17/00

[52] U.S. Cl. ..... 446/458; 273/58 B; 273/58 G; 446/462

[58] Field of Search ..... 446/431, 454, 456, 458, 446/460, 462, 484; 273/58 B, 58 G; 280/205, 206, 207; 180/21

[56] References Cited

U.S. PATENT DOCUMENTS

| | | | |
|---|---|---|---|
| 725,011 | 4/1903 | Richards | 273/58 B |
| 1,033,077 | 7/1912 | Ayers, Jr. | 446/458 |
| 2,297,489 | 9/1942 | Markes | 446/431 X |
| 2,939,246 | 6/1960 | Glos, II | 446/462 |
| 2,949,696 | 8/1960 | Easterling | 446/462 |
| 4,057,929 | 11/1977 | Ogawa | 446/462 X |
| 4,501,569 | 2/1985 | Clark, Jr. et al. | 446/458 |

FOREIGN PATENT DOCUMENTS

| | | | |
|---|---|---|---|
| 923305 | 3/1973 | Canada | 446/462 |

*Primary Examiner*—Richard T. Stouffer
*Attorney, Agent, or Firm*—Kenyon & Kenyon

[57] ABSTRACT

A radio-controllable spherical toy vehicle including a spherical toy body, a running mechanism, a fixing shaft, and a direction-control mechanism is disclosed, in which the running mechanism is rotatable circumferentially on the center-shaft by a driving motor, and the direction-control mechanism is swingable on the axle of the fixing shaft by a servo-motor.

5 Claims, 6 Drawing Figures

RADIO-CONTROLLABLE SPHERICAL TOY VEHICLE

FIELD OF THE INVENTION

This invention relates to a radio-controllable spherical toy vehicle which may be rolled forward, backward and in any desired directions by a radio-controller.

BACKGROUND OF THE INVENTION

Various types of radio-controllable toys have hitherto been proposed, most of which have, however, wheels for running (such as radio-control motor cars). Thus, novel and interesting radio-controllable toys have been requested by consumers and manufacturers.

Accordingly, an object of the invention is to provide such interesting radio-controllable toys which may be readily operated and steered by anybody.

SUMMARY OF THE INVENTION

In order to achieve the above object, the invention provides a radio-controllable spherical toy vehicle, which comprises a hollow spherical toy body having at its center a horizontal center-shaft; a running means mounted to an axial center of said center-shaft so as to be rotatable circumferentially on said center-shaft; a fixing shaft horizontally secured to a base frame of said running means normally to the axial direction of said center-shaft; and a direction-control means mounted to said fixing shaft so as to be swingable on an axis of the latter; said running means being rotatable circumferentially on said center-shaft by a driving motor, and said direction-control means being swingable on the axis of said fixing shaft by a servo-motor.

For better understanding, the invention will now be described in more detail for its preferred embodiments with reference to the accompanying drawings.

PREFERRED EMBODIMENTS OF THE INVENTION

Figure 1:
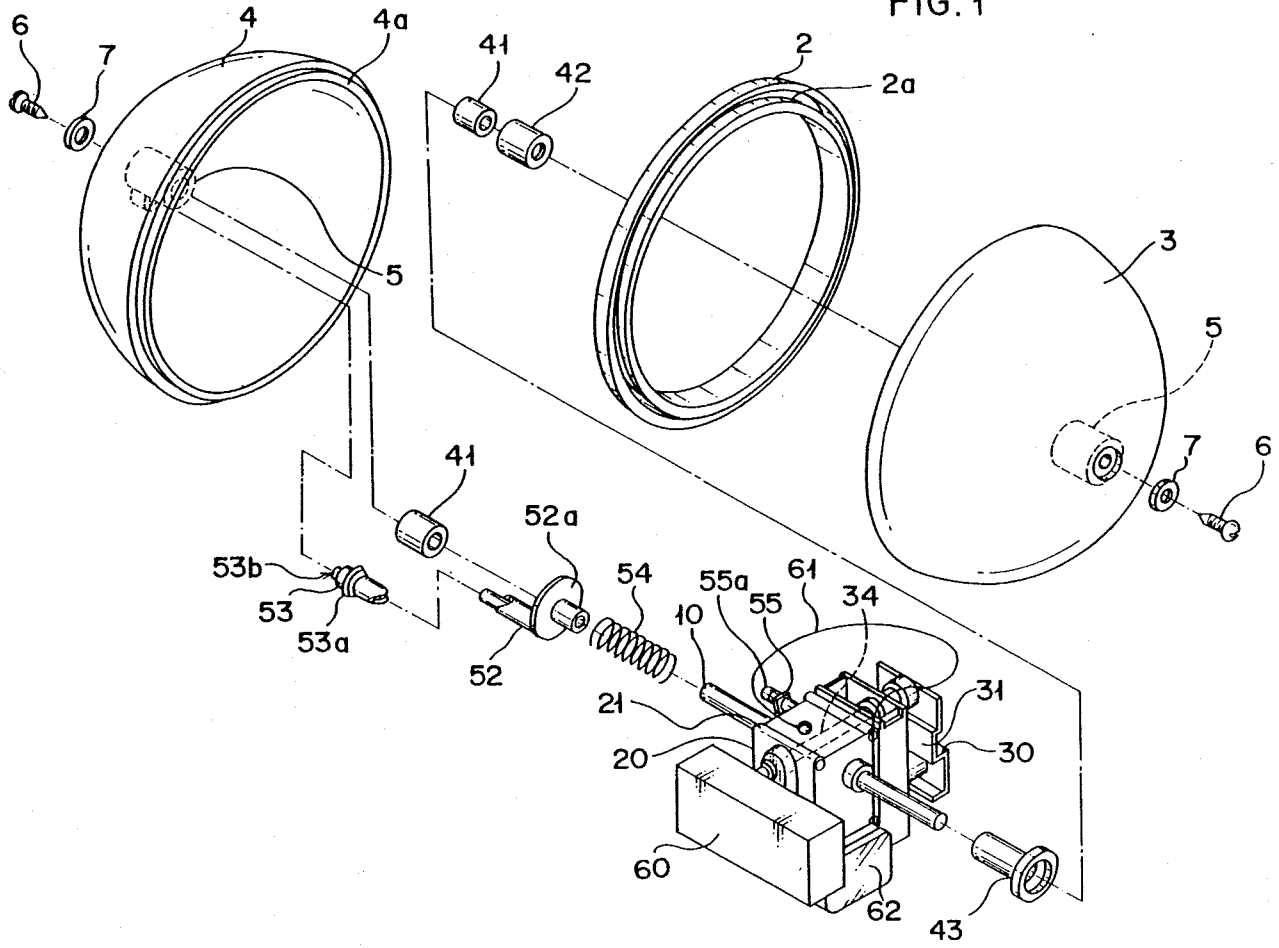
FIG. 1 is a broken perspective view of the radio-controllable spherical toy vehicle according to the invention.
Figure 2:
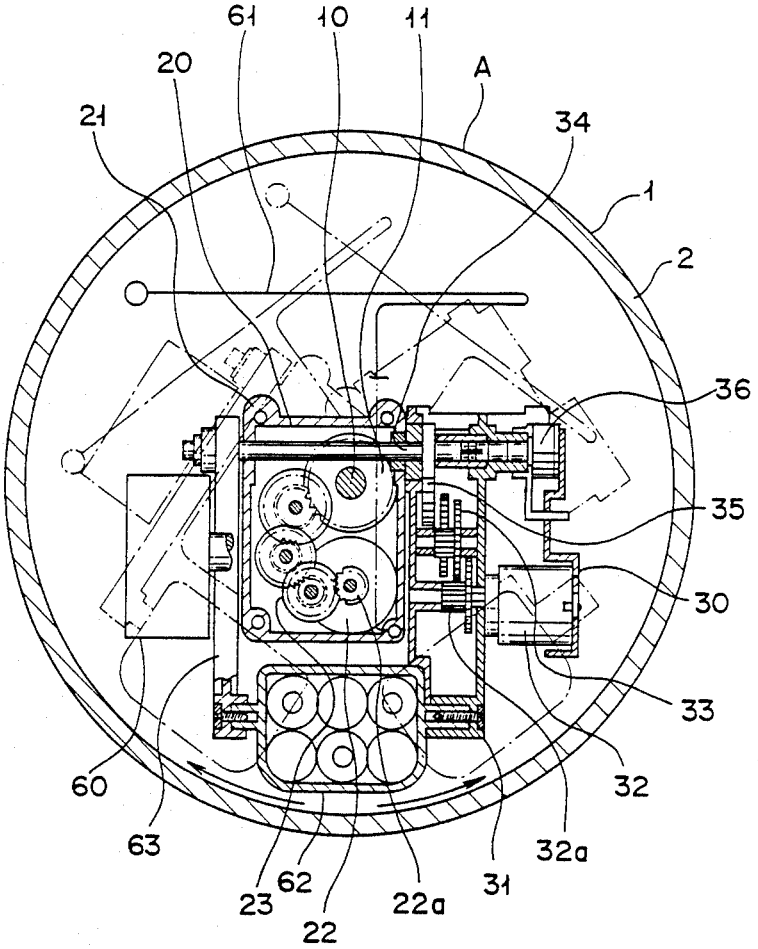
FIG. 2 is a partially cut-off side view.
Figure 3:
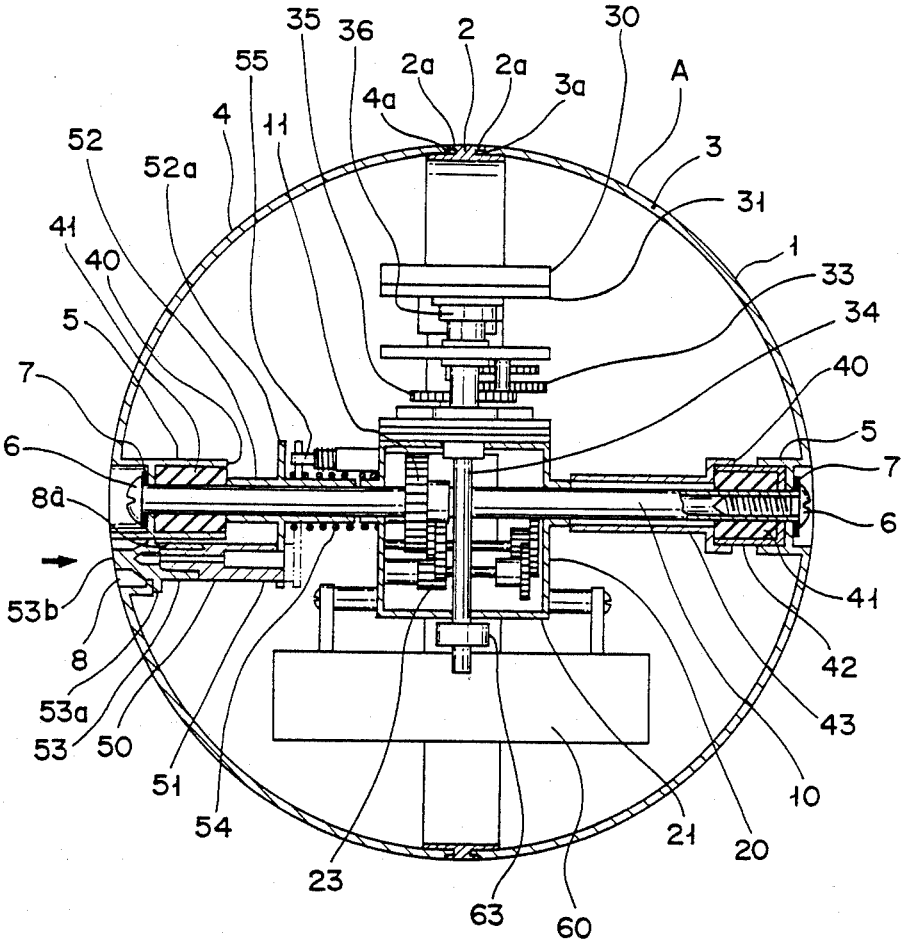
FIG. 3 is a partially cut-off plan view.
Figure 4:
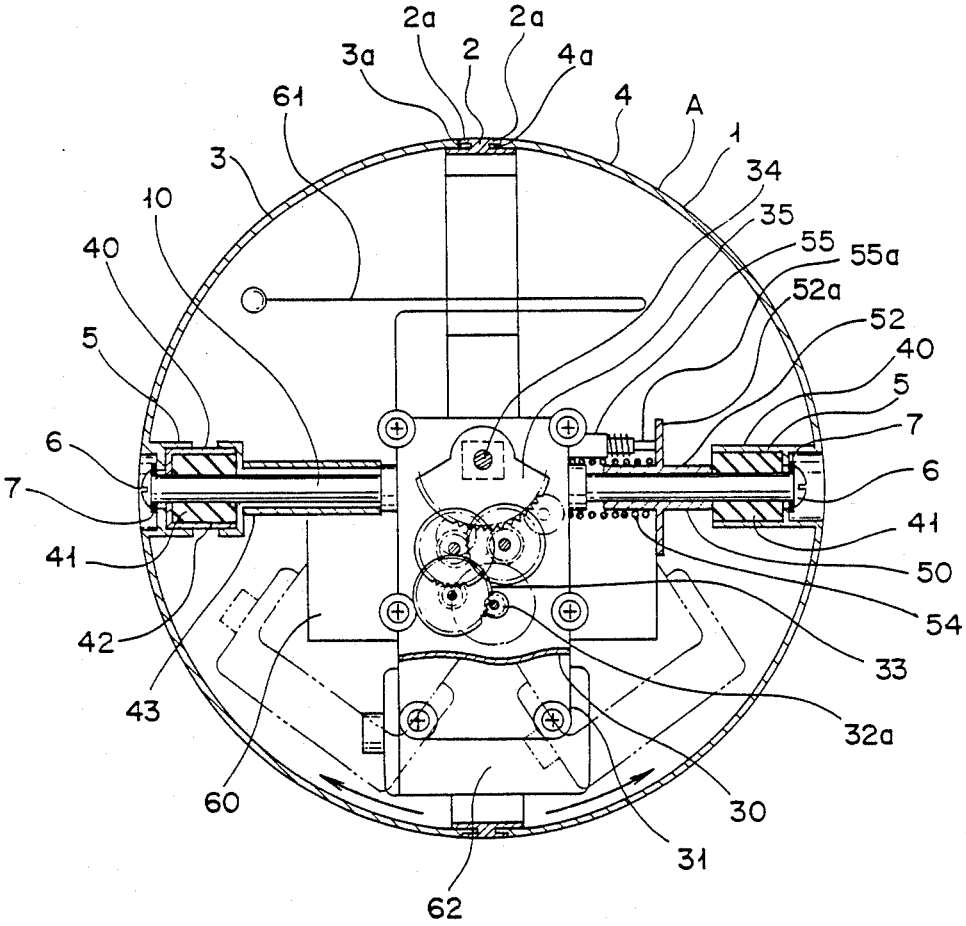
FIG. 4 is a partially cut-off front view.
Figure 5:
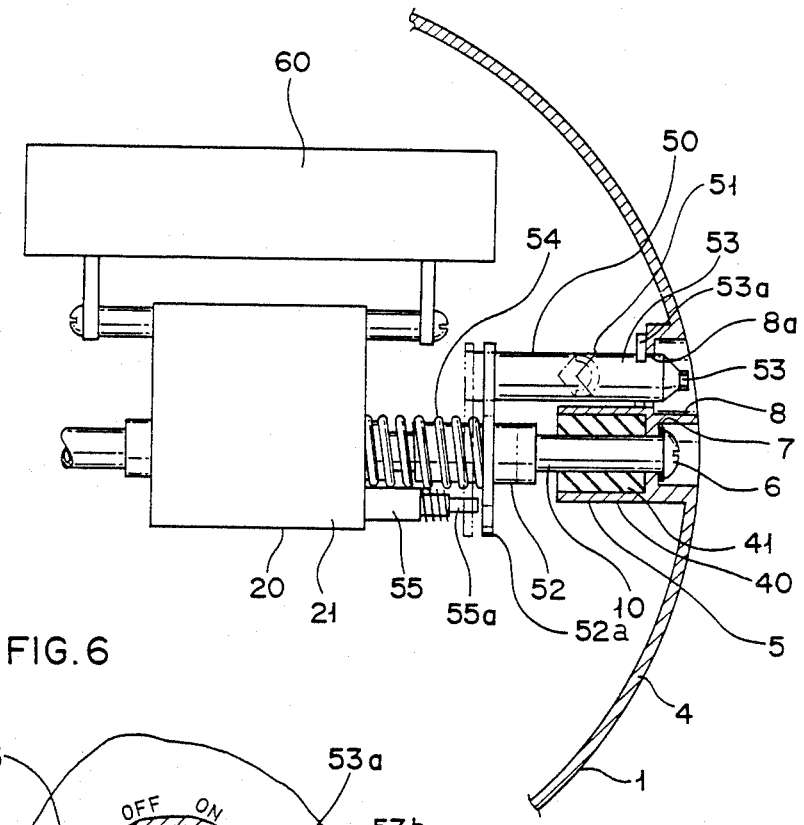
FIG. 5 is a partially cut-off plan view of main portions.

In the drawings, reference symbol A represents spherical toy vehicle according to the invention, which comprises a hollow spherical toy body 1, a running means 20 mounted to an axial center of a center-shaft 10 horizontally arranged in a center of the spherical toy body 1, and a direction-control means 30 mounted to a fixing shaft 34 which in turn is horizontally arranged on a base frame 21 of the running means 20 in a direction normal to an axial direction of the center-shaft 10.

The spherical toy body 1 may be made of a plastic material and comprises a central element 2 of substantially annular strip, a right-side element 3 of substantially hemi-spherical shell, and a left-side element 4 identical to the element 3. Further, the central element 2 at its peripheral edge is provided circumferentially with a fitting groove 2a, while the right- and left-side elements 3, 4 at their peripheral open edges are provided circumferentially with respective fitting protrusions 3a, 4a engagable into the fitting groove 2a. The spherical toy body 1 may be of exactly hollow spherical shape, although a horizontal outer diameter (across the central, the right-side and the left-side elements 2, 3 and 4) may be smaller than a vertical outer diameter (corresponding to an outer diameter of the central element 2) in order to facilitate direction-change of the spherical toy body 1 to the right or the left.

Reference numeral 5 in the drawings represent a substantially cylindrical rubber casing for receiving a shock-absorbing rubber cylinder 41 of a shock-absorber 40, as described hereinafter. The rubber casing 5 is protruded inwardly at a center of each of the right- and left-side elements 3, 4. Reference 6 represents a connecting screw threadable into one end of the center-shaft 10 for mounting the latter horizontally to a center of the spherical toy body 1, while reference 7 represents a washer.

The running means 20 comprises a base frame 21 having its upper portion attached rotatably to the center-shaft 10, a driving motor 22 received in the base frame 21, and a reduction gear array 23 for reducing rotation rate of the driving motor 22 and transmitting the rotational force to the running gear 11 fixed to the center-shaft 10. Thus, rotation of the driving motor 22 allows the running means 20 to rotate on the center-shaft 10 through a pinion 22a which is fixed to a motor shaft of the driving motor 22, and through the reduction gear array 23 and the running gear 11.

The direction-control means 30 comprises, on the other hand, a base frame 31 swingably mounted to one end of a fixing shaft 34 fixed on the upper portion of the base frame 21, a servo-motor 32 received in the base frame 31, and a reduction gear array 33 for reducing rotation rate of the servo-motor 32 and transmitting the rotational force to a sector gear 35 fixed to the fixing shaft 34. Thus, rotation of the servo-motor 32 allows the direction-control means to swing to the right or the left at a certain angle (about 35° from a neutral position) through a pinion 32a which is fixed to a motor shaft of the servo-motor 32 and through the reduction gear array 33 and the sector gear 35.

Reference 36 in the drawings represents an electric volume for controlling the swingable range of the direction-control means 30 electrically, which at its knob front is engaged with one end of the fixing shaft 34 while at its body is mounted to the base frame 31.

Reference 40 represents a shock-absorbing means which is arranged between either end of the center shaft 10 and the spherical toy body 1 for absorbing vibration and shock exerted on the toy body 1 in order to prevent them from being transmitted directly to the running means 20 and the direction-control means 30 in the toy body 1, as well as to a receiving set 60. The shock-absorbing means 40 may be constructed, for example, by inserting one end of the center-shaft 10 into a shock-absorbing rubber cylinder 41 having suitable elasticity which in turn is received in a cylindrical rubber casing 5 with or without cylindrical spacers 42, 43.

Figure 6:
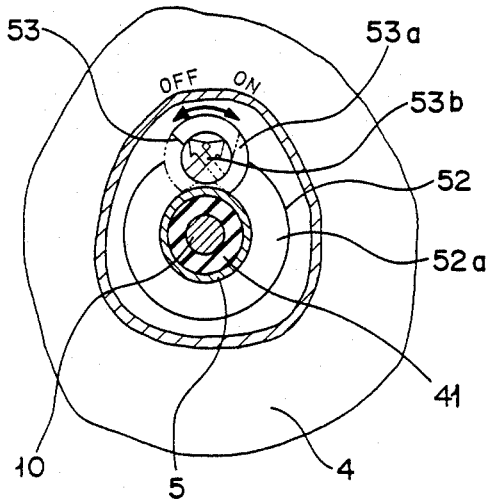
FIG. 6 is a partially cut-off side view of main portions.

Electric current to the receiving set 60, the driving motor 22 for the running means 20 and the servo-motor 32 for the direction-control means 30 may be operated by a switch means 50 which comprises a switch-activating element 51 having a base 52 at its cylindrical portion inserted rotatably and slidably onto the center-shaft 10 and having a knob 53 at its front portion inserted into a hole 8a passing through a concave bottom wall 8 of the spherical toy body 1, an elastic spring 54 having its front end abutted against a switch-pushing disc 52a of the switch base 52 for normally urging the latter toward an end of the center-shaft 10, and a switch 55 having a pushing button 55a provided on, for example, the base frame 21 of the running means 20. According to the switch means 50 thus constructed, the front end of the knob 53 exposed outside the toy body 1 is twisted (about 90°) to allow a V-shaped groove of the switch base 52 to be released from the corresponding engaged portion of the knob 53 while keeping their contact due to their corresponding specific shape for gradual engaging or disengaging movement. Then, the switch base 52 slides toward the center of the center-shaft 10 against an elastic force of the spring 54 to keep the switch-pushing disc 52a urging the button 55a of the switch 55, thereby to put the latter in its ON state. A distance between the pushing button 55a and the center-shaft 10 is shorter than a radius of the switch-pushing disc 52a for enabling the latter to surely push the button 55a irrespective of the switch position which is movable with the running means 20. Reference 53a in the drawings represents a flange piece protruded from a circumference of the switch knob 53, which at its side edge is contacted with an outer circumference of the rubber casing 5 for twisting the knob 53 at an angle of about 90°. When the flange piece 53a at its one side edge is kept contact with the outer circumference of the rubber casing 5 (ON-state), the inverted V-shape portion of the knob 53 is engaged with the V-shape portion of the switch base 52, as shown in FIG. 6, thereby to prevent rotation of the knob 53 and thus to ensure the ON-state of the switch 55. Reference 53b shows an arrow for conveniently recognizing the ON- or OFF-state of the switch 55.

Reference 61 represents an antenna connected to a receiver set 60, while reference 62 represents a battery chamber which is arranged between a lower portion of an arm 63 swingably attached at its upper portion to the other portion of the fixing shaft protruding from the base frame 21 and a lower portion of the base frame 31 of the direction-control means 30. The battery chamber 62 contains a dry-battery for operating the receiver set 60, the driving motor 22 for the running means 20 and the servo-motor 32 for the direction-control means 30.

The spherical toy vehicle thus constructed according to the invention may be operated in the following manner: the switch knob 53 is twisted to urge the pushing button 55a by the switch-pushing disc 52a of the switch base 52, thereby to put the switch 55 into the ON-state. Then, a transmitter is operated for the receiver 60 to drive the driving motor 22 of the running means 20. Thus, the driving force of the motor 22 is transmitted through the reduction gear mechanism 23 to the running gear 11 for rotating the running means 20 in a selected direction (forward or backward) relative to the center-shaft 10 together with rotation of the battery chamber 62 and the direction-control means 30. In this case, when the running means 20 moves in a certain direction for rotation, the gravity center of the spherical toy body A moves in the moving direction of the running means 20, thereby to allow the toy body A to start rolling due to the tendency of the gravity center to be located-directly beneath the center-shaft 10 and thus to continue its rolling.

Then, the transmitter is operated for the receiver 60 to drive the servo-motor 32 of the direction-control means 30. Thus, the driving force of the servo-motor 32 is transmitted through the reduction gear mechanism 33 to the sector gear 35, thereby to allow the direction-control means 30 to swing in the right or the left relative to the fixing shaft 34 together with the battery chamber 62. As the result, the gravity center of the toy body A moves to the right or the left and to incline the toy body toward the corresponding direction in order to control the rolling direction of the spherical toy vehicle at operator's disposal.

In accordance with the invention, the spherical toy vehicle A comprises the hollow spherical toy body 1 having at its center the horizontal center-shaft 10; the running means 20 mounted to the axial center of the center-shaft 10 so as to be rotatable circumferentially on the latter; the fixing shaft 34 horizontally secured to the base frame 21 of the running means 20 normally to the axial direction of the center-shaft 10; and the direction-control means 30 mounted to the fixing shaft 34 so as to be swingable on the axis of the latter; in which the running means 20 is rotatable circumferentially on the center-shaft 10 by the driving motor 22 while the direction-control means 30 is swingable on the axis of the fixing shaft 34 by the servo-motor 32. Thus, the running means 20 may be rotated circumferentially on the center-shaft 10 by the driving motor 22 while the direction-control means 30 may be swung on the axis of the fixing shaft 34 by the servo-motor 32, so that movement of the gravity center of the spherical toy body A due to rotation of the running means 20 may roll the spherical toy vehicle itself forward or backward, and that shift of the gravity center due to the swinging movement of the direction-control means 30 may roll the spherical toy vehicle to the right or the left. Further, combination of the running means 20 with the direction-control means 30 may allow the rolling movement of the spherical toy in any direction at operator's disposal, resulting in a very amusing toy.

In the spherical toy vehicle according to the invention, the toy body 1 comprises the central element 2 of substantially annular strip; the right-side element 3 of substantially hemispherical shell; and the left-side element 4 of substantially hemispherical shell, in which the central element 2 at its peripheral edge is provided circumferentially with the fitting groove 2a, while the right- and left-side element 3, 4 at their peripheral edges are provided circumferentially with respective fitting protrusions 3a, 4a fittable into the fitting groove 2a, so that assembling of the central element 2 with the right- and left-side elements 3, 4 may be surely and conveniently accomplished with the strong and durable toy body 1.

Further, in the spherical toy vehicle according to the invention, the shock-absorbing means 40 of the shock-absorbing rubber cylinder 41 having suitable elasticity is inserted between either ends of the center-shaft 10 and the spherical toy body 1, so that shock due to clash of the toy against walls or vibration due to rolling movement of the toy body may be prevented from damaging the receiving set 60, the running means 20 and/or the direction-control means 30 for ensuring the safe radio-control operation.

Still further, in the spherical toy vehicle according to the invention, the center-shaft 10 is inserted into the rotatable and slidable switch-activating element 51 having the knob 53 which at its front portion is inserted into the hole 8a passing through the concave bottom wall 8 of the spherical toy body 1, while the switch-activating element 51 at its base is provided circumferentially with the switch-pushing disc 52*a* for pushing the switch button 55*a* fixed to the base frame 21 of the running means 20, so that the switch button 55*a* of the switch 55 may be conveniently and surely operated by the switch-pushing disc 52*a* irrespective of any moving position of the running means 20 and that the switching operation may be effected conveniently outside the toy body. In addition, the ON-state of the switch 55 may be surely maintained without risk of releasing the ON-state due to vibration or shock and without invasion of dusts or sands into the toy body.

The battery chamber 62 may be located at the lower space below the running means 20 and the direction-control means 30 and contains a heavy dry-battery, so that shift of the gravity center of the toy vehicle A may be rapid and large thereby to provide quick and satisfactory rolling movement for the spherical toy vehicle.

Thus, in accordance in the invention, the spherical toy vehicle may be rolled at operator's disposal in any direction by the radio-control operation and may be constructed in a simple and strong structure with little or no trouble.

What is claimed is:

1. A radio-controllable substantially spherical toy vehicle, which comprises a hollow, substantially spherical toy body having at its center a horizontal center-shaft; a running means mounted to an axial center of said center-shaft so as to be rotatable circumferentially on said center-shaft; a fixing shaft horizontally secured to a base frame of said running means normally to the axial direction of said center-shaft; and a direction-control means mounted to said fixing shaft so as to be swingable on an axis of the latter; said running means being rotatable circumferentially on said center-shaft by a driving motor, said direction-control means being swingable on said axis of said fixing shaft by a servo-motor and wherein said substantially spherical toy body comprises a central element of substantially annular strip, a right-side element of substantially hemispherical shell and a left-side element of substantially hemispherical shell, said central element at its peripheral edge being provided circumferentially with a fitting groove, while said right-side and left-side elements at their peripheral open edges being provided circumferentially with respective fitting protrusions fittable into said fitting groove; a rotatable and slidable switch-activating element having a rotatable knob inserted into a hole passing through a concave bottom wall of said spherical toy body; said switch-activating element having at its base a switch-pushing disk into which said center-shaft is inserted; a switch button fixed to said base frame of said running means; said knob, when rotated, causing said disk to slide along said center-shaft to push said switch button to permit switch operation of said driving motor.

2. A radio-controllable substantially spherical toy vehicle according to claim 1 wherein a shock-absorbing means having appropriate elasticity is inserted between at least one end of the center-shaft and the spherical toy body for mounting the center-shaft to the spherical toy body.

3. A radio-controllable substantially spherical toy vehicle, according to claim 2, wherein said shock-absorbing means comprises a rubber casing adapted to receive said at least one end of said horizontal center-shaft.

4. A radio-controllable substantially spherical toy vehicle, according to claim 3, wherein said shock-absorbing means further comprises a rubber cylinder adapted to receive said horizontal center-shaft and be received within said rubber casing.

5. A radio-controllable substantially spherical toy vehicle, according to claim 1, wherein said substantially annular strip has an outer diameter greater than an outer diameter measured across said right-side and left-side elements.

* * * * *